US008944475B2

(12) United States Patent
Ruderer et al.

(10) Patent No.: US 8,944,475 B2
(45) Date of Patent: Feb. 3, 2015

(54) METHODS AND SYSTEMS FOR KNOTTING A BEAD

(75) Inventors: Richard Ruderer, University City, MO (US); Corey Feit, St. Louis, MO (US); Dale Picolet, St. Louis, MO (US); Chad Stuemke, St. Louis, MO (US)

(73) Assignee: Knot-A-Bead LLC, St. Louis, MO (US)

( * ) Notice: Subject to any disclaimer, the term of this patent is extended or adjusted under 35 U.S.C. 154(b) by 225 days.

(21) Appl. No.: 13/606,764

(22) Filed: Sep. 7, 2012

(65) Prior Publication Data

US 2014/0070532 A1 Mar. 13, 2014

(51) Int. Cl.
*B65H 69/04* (2006.01)

(52) U.S. Cl.
USPC ..... 289/1.5; 289/16; 289/17

(58) Field of Classification Search
USPC ..... 289/1.5, 2, 16, 17; 223/48; 29/896.4
See application file for complete search history.

(56) References Cited

U.S. PATENT DOCUMENTS

| | | | | | |
|---|---|---|---|---|---|
| 1,522,571 | A | | 1/1925 | Becker | |
| 1,621,868 | A | * | 3/1927 | Boedker | 289/17 |
| 2,498,920 | A | * | 2/1950 | Holland | 289/17 |
| 2,762,540 | A | | 9/1956 | Martinson et al. | |
| 3,377,676 | A | * | 4/1968 | Furst | 28/193 |
| 3,576,160 | A | | 4/1971 | Myer | |
| 3,945,092 | A | | 3/1976 | Andrews | |
| 4,184,645 | A | | 1/1980 | Starling | |
| 4,222,220 | A | | 9/1980 | Nolt et al. | |
| 4,400,025 | A | * | 8/1983 | Dennison | 289/17 |
| 4,493,498 | A | | 1/1985 | Vansteelant | |
| 4,525,003 | A | | 6/1985 | Tate, Jr. | |
| 4,544,145 | A | | 10/1985 | Norlander | |
| 4,790,575 | A | | 12/1988 | Tate | |
| 4,870,772 | A | | 10/1989 | Johns | |
| 5,011,197 | A | | 4/1991 | Molitorisz | |
| 5,236,232 | A | | 8/1993 | Broberg | |
| 5,536,051 | A | * | 7/1996 | Morin | 289/17 |
| 5,791,699 | A | | 8/1998 | High | |
| 5,951,067 | A | | 9/1999 | High | |
| 6,412,833 | B2 | * | 7/2002 | Lusk et al. | 289/17 |
| 6,485,065 | B2 | * | 11/2002 | Lusk et al. | 289/1.2 |
| 7,566,022 | B1 | | 7/2009 | McKinley et al. | |
| 8,002,316 | B2 | | 8/2011 | Oliveto | |
| 2001/0030423 | A1 | * | 10/2001 | Lusk et al. | 289/17 |
| 2004/0004355 | A1 | * | 1/2004 | Beers | 289/17 |
| 2010/0019495 | A1 | * | 1/2010 | Oliveto | 289/1.5 |
| 2010/0194110 | A1 | | 8/2010 | Ng | |
| 2011/0168746 | A1 | | 7/2011 | Kamiyama | |
| 2011/0204554 | A1 | * | 8/2011 | Younger | 269/54 |
| 2011/0298212 | A1 | * | 12/2011 | Oliveto | 289/2 |

* cited by examiner

*Primary Examiner* — Shaun R Hurley
(74) *Attorney, Agent, or Firm* — Armstrong Teasdale LLP

(57) ABSTRACT

A knotting mechanism includes a rod having a tapered end. The retaining mechanism includes a first leg and a second leg. A nook is defined between the first and second legs. The retaining mechanism is actuatable between an open configuration to selectively provide access to at least a portion of the nook and a closed configuration to selectively restrict access to at least the portion of the nook.

19 Claims, 8 Drawing Sheets

500

METHODS AND SYSTEMS FOR KNOTTING A BEAD

BACKGROUND

The present disclosure relates generally to making jewelry and, more particularly, to methods and systems for use in knotting a bead.

At least some known beaded jewelry includes a string and a plurality of beads spaced at predetermined intervals along the string. The bead may be knotted to maintain a bead spacing. For example, at least some known beaded jewelry includes a knot tied to either and/or both sides of a bead. Manually knotting the beads may be time consuming and/or imprecise. To facilitate decreasing a knotting time and/or increasing a knotting precision, at least some known bead knotting devices enable a knot to be retained against a bead as the knot is being tightened. However, at least some known bead knotting devices require at least one hand to hold the device while knotting the beads, making the process tedious and/or inconsistent.

BRIEF DESCRIPTION

In one aspect, a method is provided for knotting a bead. The method includes creating a first knot in a string. A first end of the string is extended through an opening defined in a bead. The string is tied around a rod to create a second knot such that the bead is positioned between the first and second knots. A first hand of a user is used to pull the first end of the string while a second hand of the user is used to remove the rod from the second knot.

In another aspect, a device is provided for use in knotting a bead. The device includes a knotting mechanism and a retaining mechanism. The knotting mechanism includes a rod having a tapered end. The retaining mechanism includes a first leg and a second leg. A nook is defined between the first and second legs. The retaining mechanism is actuatable between an open configuration to selectively provide access to at least a portion of the nook and a closed configuration to selectively restrict access to at least the portion of the nook.

In yet another aspect, a device is provided for use in knotting a bead. The device includes a knotting mechanism and a retaining mechanism. The knotting mechanism includes a rod having a tapered end. The retaining mechanism includes a first leg, a second leg, and an offset portion such that a slot is defined between the offset portion and at least one of the first and second legs. A nook is defined between the first and second legs.

The features, functions, and advantages described herein may be achieved independently in various embodiments of the present disclosure or may be combined in yet other embodiments, further details of which may be seen with reference to the following description and drawings.

Although specific features of various embodiments may be shown in some drawings and not in others, this is for convenience only. Any feature of any drawing may be referenced and/or claimed in combination with any feature of any other drawing.

DETAILED DESCRIPTION

The subject matter described herein relates generally to making jewelry and, more particularly, to methods and systems for use in knotting a bead. The embodiments described herein enable a user to quickly, precisely, and consistently knot a bead with two hands. In one embodiment, a first knot is created in a string. A first end of the string is extended through an opening defined in a bead. The string is tied around a rod to create a second knot such that the bead is positioned between the first and second knots. A first hand is used to pull the first end of the string while a second hand is used to remove the rod from the second knot.

As used herein, the term "string" refers to any extension member including, without limitation, a cord, a line, a rope, a twine, a thread, a cable, a yarn, a filament, a fiber, a wire, and the like. As used herein, an element or step recited in the singular and preceded with the word "a" or "an" should be understood as not excluding plural elements or steps unless such exclusion is explicitly recited. Furthermore, references to "one embodiment" of the present invention or the "exemplary embodiment" are not intended to be interpreted as excluding the existence of additional embodiments that also incorporate the recited features.

Figure 1:
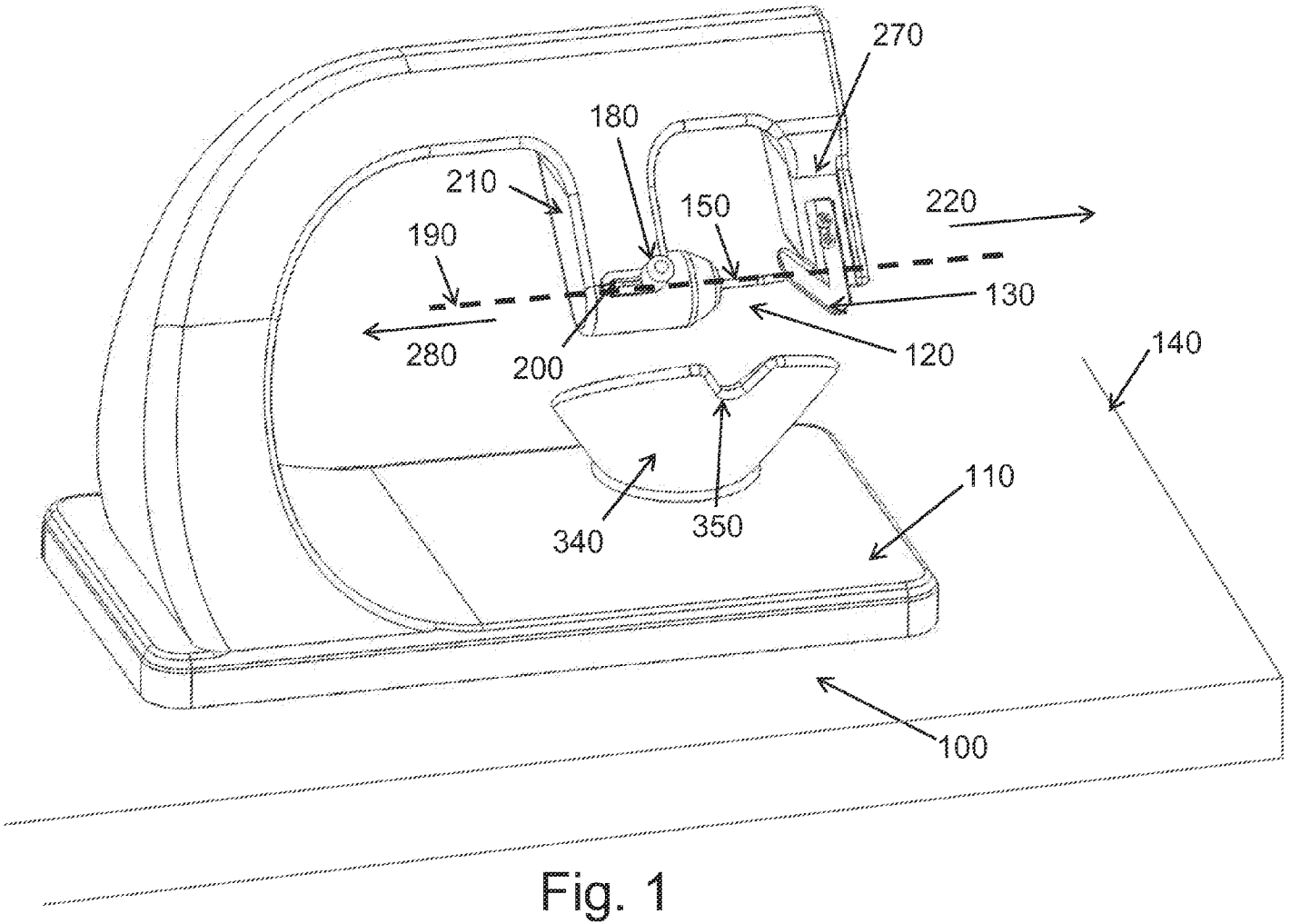
FIG. 1 is a perspective view of an exemplary bead knotting system.
Figure 2:
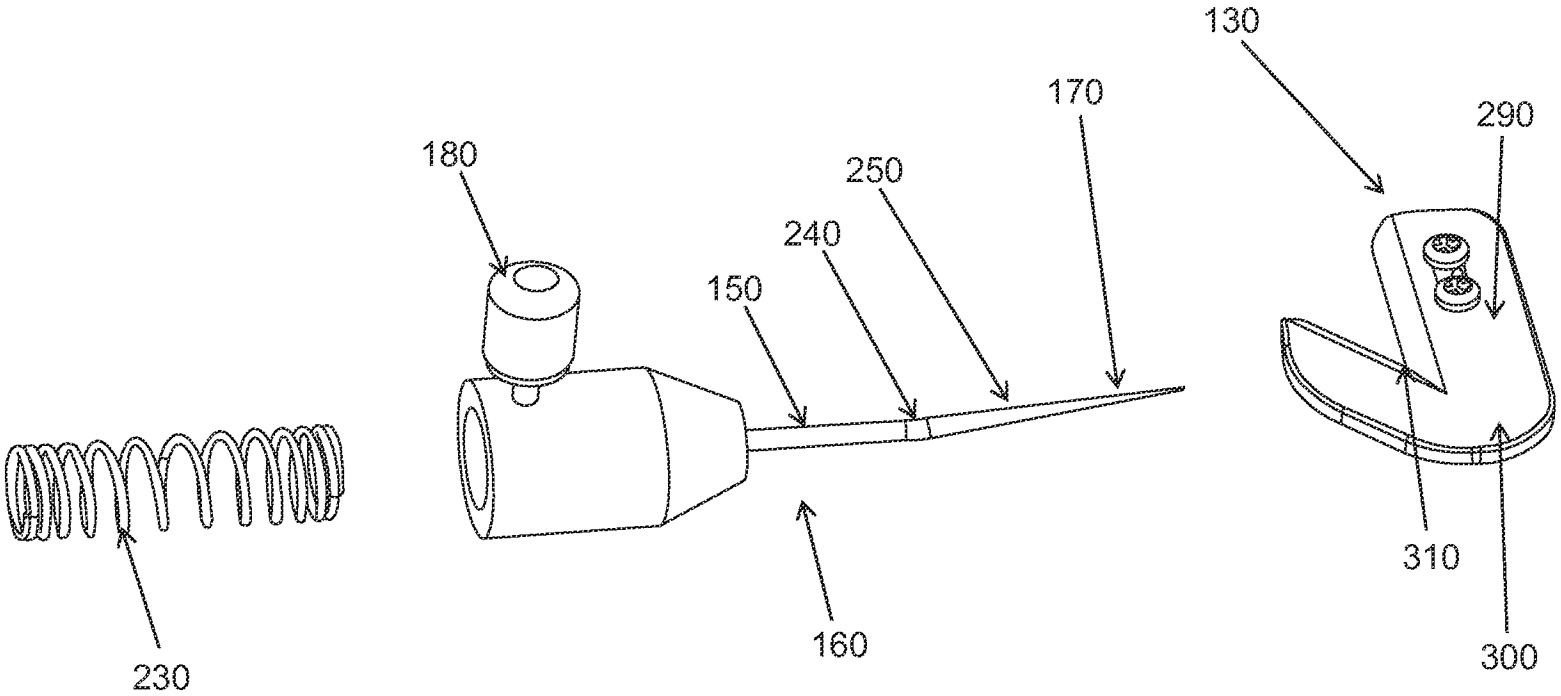
FIG. 2 is an exploded perspective view of an exemplary knotting and retaining mechanisms that may be used with the bead knotting system shown in FIG. 1.

FIG. 1 is a perspective view of an exemplary bead knotting system 100. In the exemplary embodiment, system 100 includes a base 110, a knotting mechanism 120 coupled to base 110, and a retaining mechanism 130 coupled to base 110. FIG. 2 is an exploded perspective view of knotting mechanism 120 and retaining mechanism 130.

In one embodiment, base 110 is selectively coupleable to a surface 140. For example, base 110 may include a coupling mechanism including, without limitation, a plurality of suction cups, a clamp, a vice, and/or any other coupling mechanism that enables system 100 to function as described herein. The coupling mechanism facilitates maintaining a relative positioning of system 100 with respect to surface 140. Additionally or alternatively, base 110 may be weighted such that the relative positioning of system 100 may be maintained with respect to surface 140. Additionally or alternatively, a bottom surface of base 110 includes a damping mechanism including, without limitation, felt, rubber, foamed plastic, and/or any other damping mechanism that enables system 100 to function as described herein. The damping mechanism facilitates reducing an affect the bottom surface of base 110 would have on surface 140.

In the exemplary embodiment, knotting mechanism 120 includes a rod 150 having a root 160 and a tapered end 170. In the exemplary embodiment, a knob 180 enables a user to axially move rod 150 along a longitudinal axis 190. More specifically, knob 180 is coupled to root 160 and is slideable within a groove 200 defined in a first arm 210 to axially move rod 150 along longitudinal axis 190. In the exemplary embodiment, rod 150 is biased to move towards a first axial direction 220 towards tapered end 170. For example, as shown in FIG. 2, root 160 is coupled to a biasing mechanism 230, e.g., a spring. Alternatively, rod 150 may be biased in any direction that enables system 100 to function as described herein.

In the exemplary embodiment, rod 150 is generally straight and includes a bend 240 at an obtuse angle between root 160 and tapered end 170. More specifically, in the exemplary embodiment, a distal portion 250 of rod 150, i.e., the portion between bend 240 and tapered end 170, is bent towards retaining mechanism 130 to facilitate creating a tight knot proximate to a bead (not shown).

In the exemplary embodiment, retaining mechanism 130 includes a first leg 290 and a second leg 300 coupled to first leg 290 to define a nook 310 therebetween. In the exemplary embodiment, nook 310 is oriented to face a direction that is generally perpendicular to rod 150. Alternatively, nook 310 may be oriented to face any direction and/or have any configuration that enables system 100 to function as described herein.

In the exemplary embodiment, a guarding mechanism is coupled to a second arm 270 to at least partially cover tapered end 170. More specifically, in the exemplary embodiment, rod 150 is moveable in first axial direction 220 such that tapered end 170 is substantially covered by guarding mechanism and a second axial direction 280 opposite first axial direction 220 such that tapered end 170 is generally exposed. For example, in the exemplary embodiment, first leg 290 may function as the guarding mechanism. Additionally or alternatively, the guarding mechanism may be any component that enables system 100 to function as described herein.

In the exemplary embodiment, a portion 320 of retaining mechanism 130 is moveable between an open configuration and a closed configuration to selectively provide access and selectively restrict access, respectively, to at least a portion of nook 310. In at least some embodiments, portion 320 is biased towards the closed configuration. Alternatively, portion 320 may be biased in any direction and/or configuration that enables system 100 to function as described herein.

Figure 3:
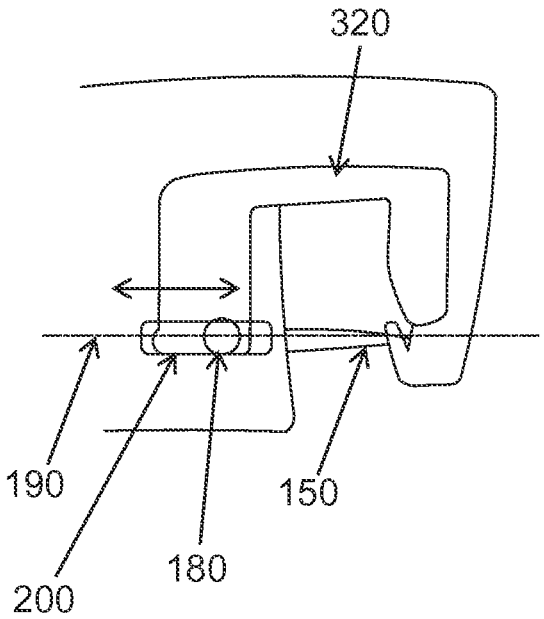
FIGS. 3-7 show exemplary retaining mechanisms that may be used with the bead knotting system shown in FIG. 1.
Figure 4:
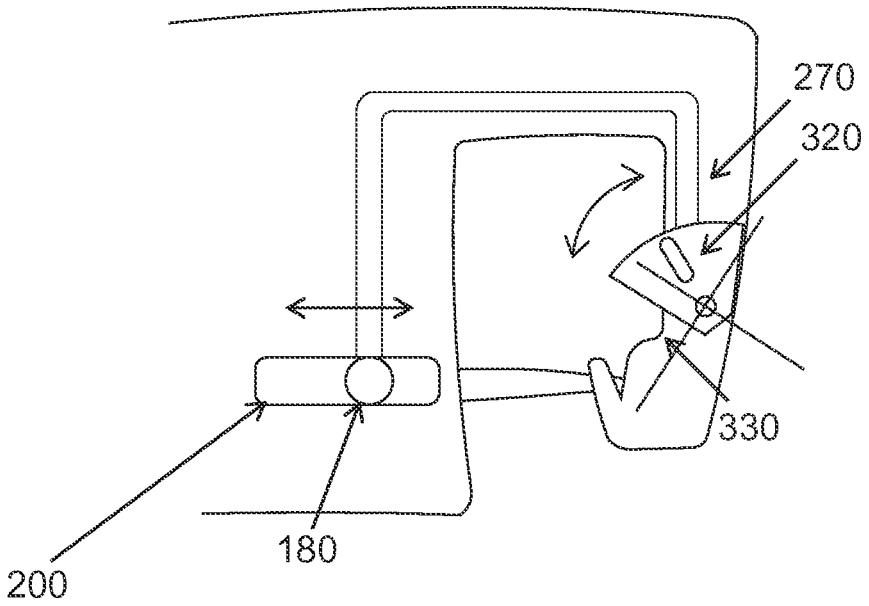
Figure 5:
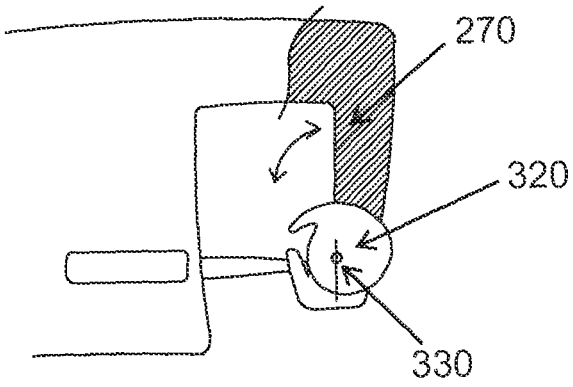

FIG. 3 shows one example of portion 320. In this embodiment, portion 320 is a shutter coupled to knob 180 such that portion 320 is moveable along longitudinal axis 190 of rod 150 between the open configuration and the closed configuration. Accordingly, knob 180 is slideable within groove 200 to translate portion 320 along longitudinal axis 190. FIG. 4 shows another example of portion 320. In this embodiment, portion 320 is a shutter coupled to second arm 270. More specifically, in the exemplary embodiment, portion 320 is coupled to knob 180 such that portion 320 is rotatable about a pivot 330 between the open configuration and the closed configuration. Accordingly, knob 180 is slideable within groove 200 to rotate portion 320 about pivot 330. FIG. 5 shows yet another example of portion 320. In this embodiment, portion 320 is a wheel coupled to second arm 270 such that portion 320 is rotatable about a pivot 330 between the open configuration and the closed configuration.

In the exemplary embodiment, a receptacle 340 is positioned generally below knotting mechanism 120 and/or and retaining mechanism 130. In the exemplary embodiment, receptacle 340 is sized to retain at least some beads. In the exemplary embodiment, receptacle 340 is configured to support at least a strand of previously-knotted beads to facilitate reducing a tension of the string extending through nook 310. In the exemplary embodiment, receptacle 340 includes a sidewall that defines a recess 350 sized to retain the strand of previously-knotted beads. Alternatively, receptacle 340 may have any configuration that enables system 100 to function as described herein.

Figure 6:
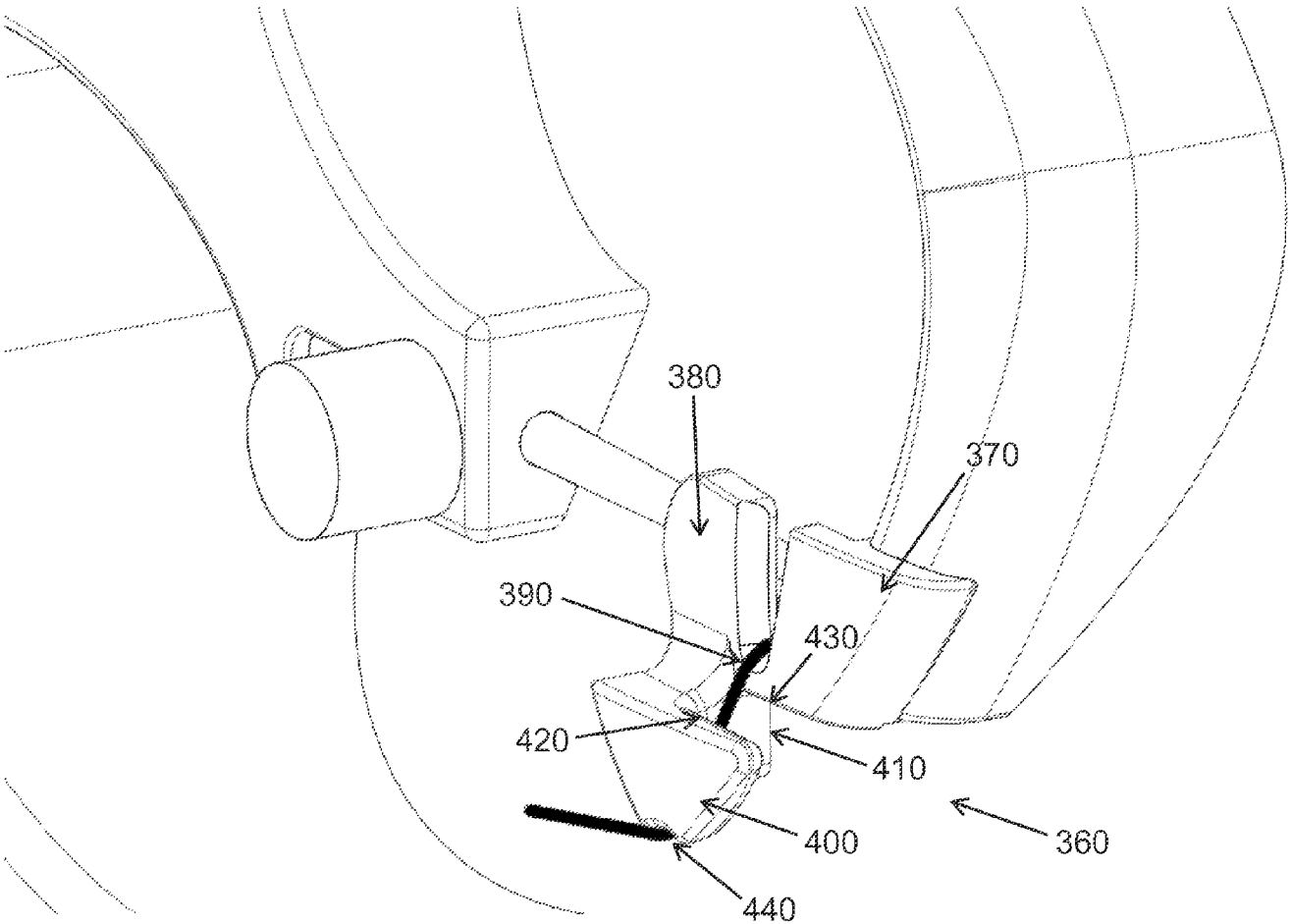
Figure 7:
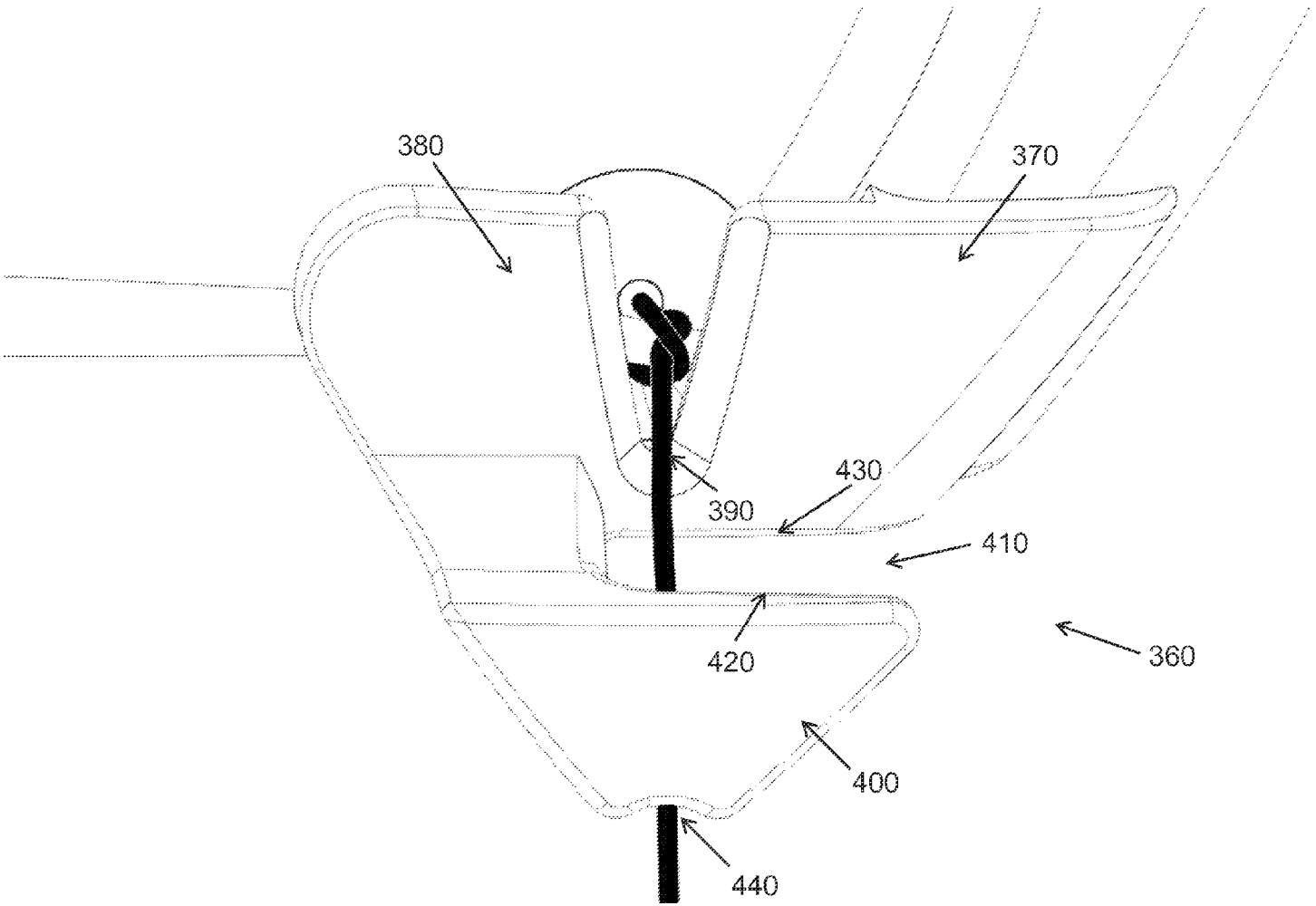

FIG. 6 is a perspective view of an alternative retaining mechanism 360. FIG. 7 is a front view of retaining mechanism 360. In the exemplary embodiment, retaining mechanism 360 includes a first leg 370 and a second leg 380 coupled to first leg 370 to define a nook 390 therebetween. In the exemplary embodiment, first leg 370 and second leg 380 generally extend in a common plane.

In the exemplary embodiment, a portion 400 of retaining mechanism 360 is offset from first leg 370 and/or second leg 380 to define a slot 410 therebetween. More specifically, in the exemplary embodiment, slot 410 is defined between an upper edge 420 of portion 400 and a lower edge 430 of first leg 370 and/or second leg 380. Accordingly, in the exemplary embodiment, portion 400 generally extends in a plane that is different from the plane of first leg 370 and/or second leg 380. In the exemplary embodiment, slot 410 is sized to receive a portion of the string.

In the exemplary embodiment, a lower edge 440 of portion 400 includes a notch 440 defined therein sized to receive a portion of the string. In the exemplary embodiment, nook 390, slot 410, and/or notch 440 are aligned such that a tension of the string extending therethrough may be selectively maintained. For example, in the exemplary embodiment, the string extends from the knot around rod 150, through nook 390 generally over first leg 370 and/or second leg 380, through slot 410 between portion 400 and first leg 370 and/or second leg 380, and through notch 440 generally under portion 400. Alternatively, the string may extend in any direction that enables system 100 to function as described herein.

Figure 8:
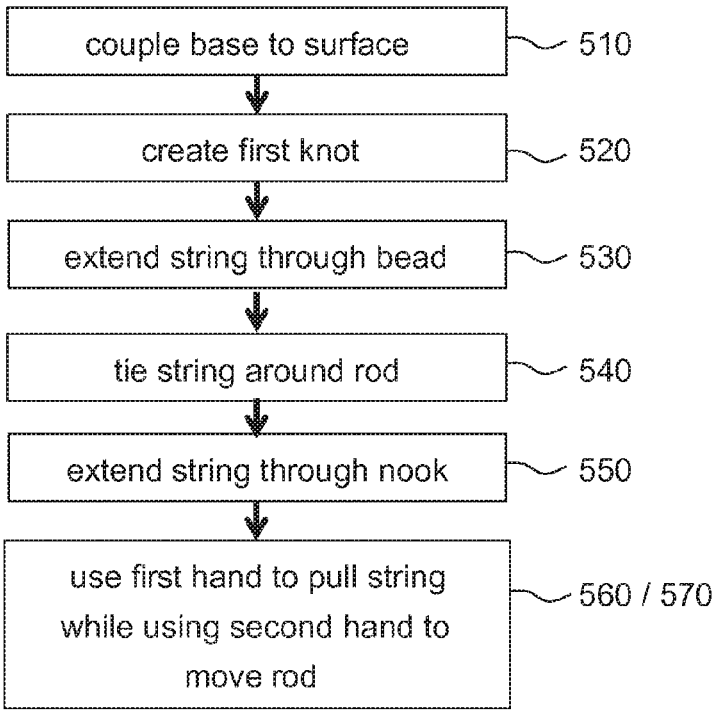
FIG. 8 is a flow chart of an exemplary method that may be used to knot beads using the bead knotting system shown in FIG. 1.

FIG. 8 is a flow chart of an exemplary method 500 that may be used to knot beads using system 100. In the exemplary embodiment, base 110 is selectively coupled 510 to surface 140. More specifically, in the exemplary embodiment, a coupling mechanism (not shown) is used to securely couple 510 base 110 to surface 140. In the exemplary embodiment, a first knot is created 520 in a string (not shown). In the exemplary embodiment, a free or first end of the string is extended 530 through an opening defined in a bead. More specifically, in the exemplary embodiment, the bead is slid along the string until the bead is substantially adjacent to the first knot.

In the exemplary embodiment, the string is tied 540 to create a second knot such that the bead is positioned between the first and second knots. More specifically, in the exemplary embodiment, the string is tied 540 around rod 150 such that rod 150 extends through a major loop portion of an overhand knot. In the exemplary embodiment, the string is positioned 550 such that the string extends through nook 310. More specifically, in the exemplary embodiment, the string is positioned such that nook 310 is positioned between the second knot and the first end of the string. In the exemplary embodiment, retaining mechanism 130 is moved towards the closed configuration to retain the string within nook 310.

In the exemplary embodiment, a first hand is used 560 to pull the first end of the string while a second hand is used 570 to move rod 150 is the second axial direction 280 such that rod 150 is removed from the second knot. More specifically, in the exemplary embodiment, the second knot is pushed off of tapered end 170 while the second knot is being tightened such that the second knot is secured substantially adjacent to the bead. In the exemplary embodiment, retaining mechanism 130 urges the second knot towards the bead. The knotting process may be repeated for each bead, and a previously-knotted bead may be positioned and/or retained within receptacle 340 to reduce a tension of the string while the knots are being tied.

The subject matter described herein enables a user to use two hands to quickly, precisely, and consistently knot a bead. More specifically, the embodiments described herein hold a string, a knot, and/or a bead in place to enable a first hand to pull the first end of the string while a second hand removes the rod from the second knot. That is, the hands are generally not needed to hold the string, the knot, and/or the bead in place.

Exemplary embodiments of methods and systems for knotting a bead are described above in detail. The systems and methods are not limited to the specific embodiments described herein, but rather, components of systems and/or steps of the method may be utilized independently and separately from other components and/or steps described herein. Each component and each method step may also be used in combination with other components and/or method steps. Although specific features of various embodiments may be shown in some drawings and not in others, this is for convenience only. Any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of knotting a bead, said method comprising:

creating a first knot in a string;

extending a first end of the string through an opening defined in a bead;

tying the string around a rod to create a second knot such that the bead is positioned between the first and second knots;

extending the string through a nook defined between a first leg of a retaining mechanism and a second leg of the retaining mechanism such that the nook is positioned between the second knot and the first end of the string; and using a first hand of a user to pull the first end of the string while a second hand of the user is used to remove the rod from the second knot.

2. A method in accordance with claim 1 further comprising moving the retaining mechanism towards a closed configuration to selectively restrict access to at least a portion of the nook.

3. A method in accordance with claim 1, wherein a base is coupled to the rod, the method further comprising securely coupling the base to a surface.

4. A method in accordance with claim 1 further comprising positioning a previously-knotted bead in a receptacle positioned generally below a pin.

5. A device for use in knotting a bead, said device comprising:

a knotting mechanism comprising a rod having a tapered end, wherein said rod is biased to move towards a first axial direction; and a retaining mechanism comprising a first leg and a second leg, wherein a nook is defined between the first and second legs, said retaining mechanism actuatable between an open configuration to selectively provide access to at least a portion of the nook and a closed configuration to selectively restrict access to at least the portion of the nook.

6. A device in accordance with claim 5, wherein said knotting mechanism further comprises a guarding mechanism, wherein said rod is moveable in a first axial direction such that the tapered end is substantially covered by said guarding mechanism and a second axial direction opposite the first axial direction such that the tapered end is generally exposed.

7. A device in accordance with claim 5, wherein a portion of said rod is bent towards said retaining mechanism.

8. A device in accordance with claim 5 further comprising a base coupled to said knotting mechanism and said retaining mechanism, wherein said base is selectively coupleable to a surface.

9. A device in accordance with claim 5 further comprising a receptacle positioned generally below said knotting mechanism and said retaining mechanism.

10. A device in accordance with claim 5, further comprising a receptacle including a sidewall that defines a recess.

11. A device in accordance with claim 5, wherein the nook is oriented to face a direction that is generally perpendicular to said rod.

12. A device in accordance with claim 5, wherein said retaining mechanism is biased towards the closed configuration.

13. A device for use in knotting a bead, said device comprising:

a knotting mechanism comprising a rod having a tapered end; and a retaining mechanism comprising a first leg, a second leg, and an offset portion, wherein a nook is defined between the first and second legs, and a slot is defined between the offset portion and at least one of the first and second legs.

14. A device in accordance with claim 13, wherein said knotting mechanism further comprises a guarding mechanism, wherein said rod is moveable in a first axial direction such that the tapered end is substantially covered by said guarding mechanism and a second axial direction opposite the first axial direction such that the tapered end is generally exposed.

15. A device in accordance with claim 13, wherein said rod is biased to move towards a first axial direction.

16. A device in accordance with claim 13, wherein a portion of said rod is bent towards said retaining mechanism.

17. A device in accordance with claim 13 further comprising a base coupled to said knotting mechanism and said retaining mechanism, wherein said base is selectively coupleable to a surface.

18. A device in accordance with claim 13 further comprising a receptacle positioned generally below said knotting mechanism and said retaining mechanism.

19. A device for use in knotting a bead, said device comprising:

a knotting mechanism comprising a rod having a tapered end;

a retaining mechanism comprising a first leg and a second leg, wherein a nook is defined between the first and second legs, said retaining mechanism actuatable between an open configuration to selectively provide access to at least a portion of the nook and a closed configuration to selectively restrict access to at least the portion of the nook; and a receptacle comprising a sidewall that defines a recess.

* * * * *